United States Patent [19]

Rodgers et al.

[11] Patent Number: 4,505,430

[45] Date of Patent: Mar. 19, 1985

[54] SELF-CLEANING ATOMIZER

[75] Inventors: Michael C. Rodgers; Geoffrey H. Michels, both of Indianapolis, Ind.

[73] Assignee: Ransburg Corporation, Indianapolis, Ind.

[21] Appl. No.: 443,169

[22] Filed: Nov. 22, 1982

[51] Int. Cl.[3] ..... B05B 3/10

[52] U.S. Cl. ..... 239/112; 239/223

[58] Field of Search ..... 239/112, 223, 224, 700–703

[56] References Cited

U.S. PATENT DOCUMENTS 3,224,680 12/1965 Burnside et al. ..... 239/112

3,504,851 4/1970 Demeter ..... 239/703

FOREIGN PATENT DOCUMENTS 32391 1/1981 European Pat. Off. .

2066701 7/1981 United Kingdom ..... 239/703

*Primary Examiner*—Andres Kashnikow

*Attorney, Agent, or Firm*—Barnes & Thornburg

[57] ABSTRACT

A rotary atomizer includes a passageway extending between, and coupling, the coating material cup and the interior of the atomizer, from an edge of which atomization occurs. The passageway initiates in the paint cup at a selected non-zero radius and terminates in the interior radially inwardly from the preselected radius. The passageway is angled both in the radial direction and tangentially. The tangential inclination is in a direction opposite the direction of revolution of the rotary atomizer.

11 Claims, 2 Drawing Figures

SELF-CLEANING ATOMIZER

Figure 1:
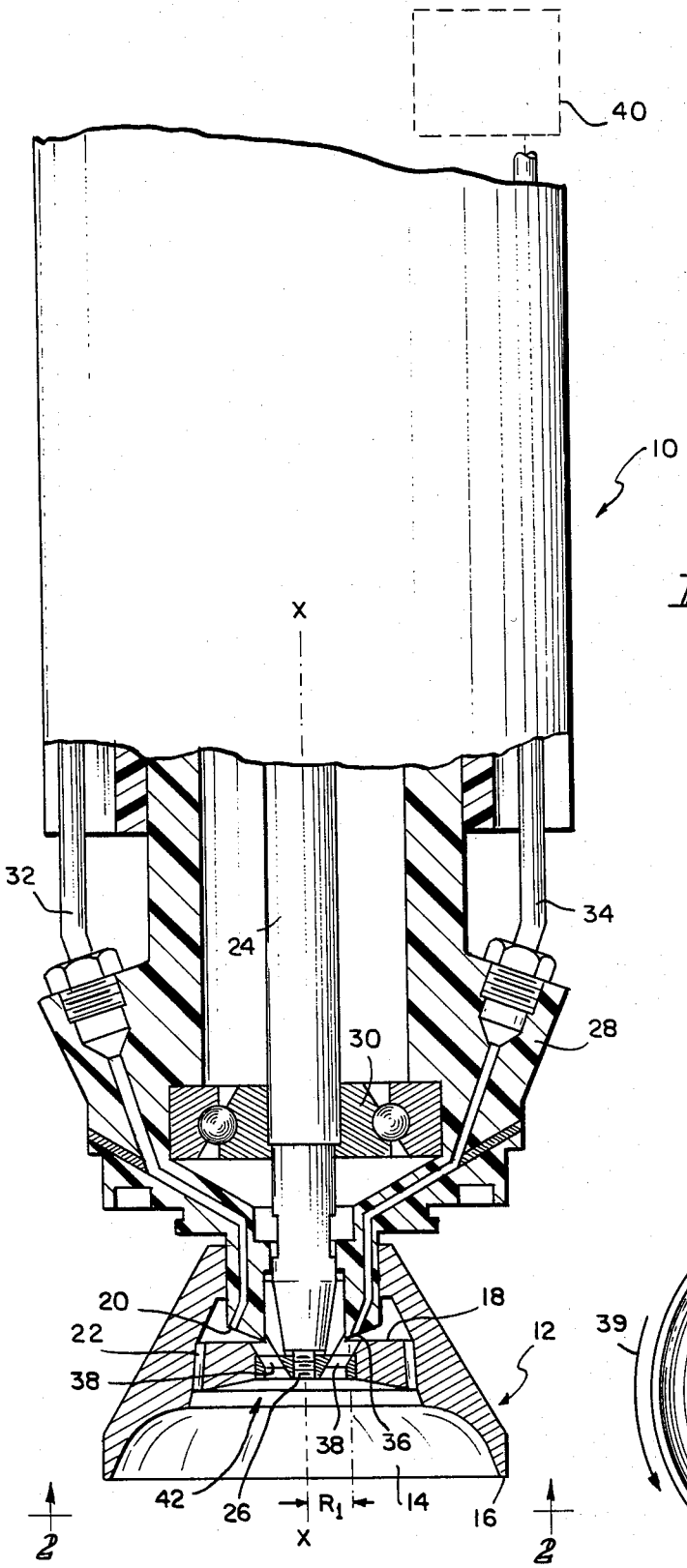

This invention relates generally to atomization and deposition of fluid coating materials such as paints, and more particularly, to atomizing devices including means for dispensing cleaning fluid to clean the device of unwanted coating materials.

Various types of atomizing devices, many of which include a means for cleaning the device of unwanted coating material, are known in the art. U.S. Pat. No. 4,275,838 discloses an atomizing device which is surrounded by a shroud mounted for reciprocal movement coaxial to the axis of rotation of the rotating atomizing device. During a coating operation, the shroud is retracted to a position where the coating material can be most favorably projected from the rotating atomizing device. After a coating operation is completed, and specifically during any change in color of the coating material to be delivered through the atomizing device, the shroud is projected coaxially forward to a point that it envelopes the rotating atomizing device. A flushing nozzle is fixed within the shroud and faces from the interior of the shroud back toward the axis of the rotating atomizing device when the shroud is in its extended position. A stream of solvent is directed onto the rotating atomizing device from the flushing nozzle to rinse any paint residue from the central region or "nose" of the device. When the rinsing operation is complete, the shroud is retracted to its original position and the coating operation initiated with the new color of coating material being fed to the atomizing device. While this prior art device operates satisfactorily, simpler and more compact nose-cleaning systems have been sought which would avoid the use of the so-called "nose-washer" flushing nozzle, with or without the reciprocably movable shroud.

Offenlegungsschrift No. 30 01 209 discloses a coating material atomizing device having an atomizing bell rotatable on a central shaft. The bell includes a ring-shaped coating material passageway coaxially about the shaft for delivery of coating material to the front face of the bell to be atomized and projected therefrom. A solvent passage is provided coincident with the axis of the bell for delivery of solvent to the front face of the bell for cleaning the bell during color change. This so-called "center-feed" orientation of the solvent delivery tube, while possible, requires a larger shaft which in turn requires larger bearings which limit the maximum rotation frequency of the shaft and atomizing device. Further, center-feed systems do not permit the use of multiple feed lines to a single atomizer for non-compatible paint types. The difficulties encountered with such a system make it desirable to achieve substantially the same effect yet without the use of a center-feed delivery tube.

In accordance with the present invention, an apparatus for atomizing a coating material includes a motor-driven atomizing device rotated about an axis of rotation in a preselected direction. The atomizing device has a front surface, a back surface, and a nozzle for directing material onto the back surface of the device from which it is then transferred to the front surface through a passageway and dispensed in the form of a mist or spray therefrom. The passageway is inwardly inclined from a preselected non-zero radius on the back surface toward the axis on the front surface of the device. Further according to the invention, the passageway is also tangentially inclined from the back surface away from the preselected direction of rotation of the rotating device.

The apparatus of the present invention avoids the use of any reciprocally movable shroud or cleaning material sprayer by incorporating one or more solvent passageways directly in the rotating element forming the atomizer, the passageways being angled from the back side to the front side of the device from a point more distant from the axis toward a point closer to the axis. While generally this inclination would cause a centrifugal force which would tend to prevent the solvent from progressing toward the center of the rotating device, other means are employed to force the solvent through the passageways while the device is rotating at high speed. In order to achieve the solvent delivery against this centrifugal force, the solvent delivery passageways can be tangentially inclined as well as axially inclined so as to act as a pump, and means for delivering the solvent cleaning material through a solvent delivery nozzle toward the passageways at high delivery velocity can be employed. One such means can be the delivery of solvent from the nozzle under pressure. Another such means is the addition of superatmospheric air to the solvent prior to delivery to the nozzle. A self-cleaning atomizer in accordance with the present invention thus avoids the use of reciprocally movable shrouds and also avoids the use of axis coincident delivery tubes as was the practice of the prior art.

Figure 2:
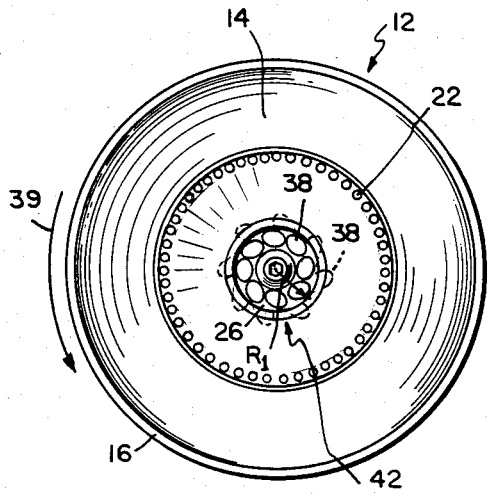

Features and advantages of the invention will become apparent to those skilled in the art upon consideration of the following detailed description of an illustrative embodiment of the invention. The detailed description particularly refers to the accompanying figures including:

FIG. 1 which illustrates a partly sectional side elevational view of a rotary atomizer and rotator motor components in accordance with the present invention; and FIG. 2 which is a fragmentary sectional view of a detail of the atomizer of FIG. 1, taken generally along section lines 2—2 thereof.

An apparatus 10 according to the present invention for atomizing coating material includes a motor-driven atomizing device 12 rotated about an axis of rotation X—X in a preselected direction. The rotary atomizer 12 comprises a dish-shaped interior 14 which flares generally outwardly from the axis X—X and terminates in an atomizing edge 16 from which atomized material is projected. Opposite the front surface 14 is a back side or surface 18 which lies generally on the outside of the atomizer 12 and faces generally in the direction opposite that in which the atomized material is projected. In the illustrated embodiment, surface 18 is the bottom of a so-called paint cup into which coating material is transferred for delivery to interior 14.

The apparatus 10 includes a coating material delivery nozzle 20 for directing coating material onto the back surface 18 of the atomizer 12. The atomizer 12 includes a coating material passageway 22 extending between and coupling the back side 18 to the interior 14 of the atomizer 12 to provide for delivery of coating material to the interior to be atomized. The coating material passageway 22 is situated so as to promote flow of the coating material outwardly when the atomizer 12 is rotated on its axis X—X by an appropriate motor (not shown) driving shaft 24. A threaded fastener 26 couples the atomizer 12 to the shaft 24. The illustrative fastener is a set screw which is threaded into a passageway formed in the end of the shaft 24. Atomizer 12 is secured to fastener 26 by an anaerobic adhesive. The apparatus further includes an atomizer support 28 journalled by bearings 30 to shaft 24 and coating material conduit 32 extending from a coating material supply to coating material delivery nozzle 20.

The apparatus 10 further includes a cleaning material conduit 34 extending between a source of cleaning material and a cleaning material delivery nozzle 36 for directing cleaning material toward the back surface 18 of the atomizer 12 at a preselected radius $R_1$ from the axis of rotation X—X. A solvent passageway 38 extends between the back side 18 and the front or interior 14 of atomizer 12, the solvent passageway 38 starting at the preselected radius $R_1$ on the back side 18 of the atomizer 12 and terminating on the front surface 14 near the axis X—X. The passageway 38 is inwardly inclined from the preselected radius $R_1$ toward the axis X—X, illustratively at 30°, and is also tangentially inclined from the back surface away from the preselected direction of rotation indicated by arrow 39, illustratively at 45° to a radius drawn from the center of threaded fastener 26, as best illustrated in FIG. 2. A means 40 for delivering the cleaning material through cleaning nozzle 36 at high velocity is connected to passageway 34 and includes means for pressurizing, and adding high pressure air to, the cleaning material for delivery through the cleaning nozzle 36 toward the back surface 18 of the motor-driven atomizer 12. For a system of the illustrated configuration, at a rotation frequency of 40,000 rpm, a suitable air pressure is 20 psi and a suitable solvent pressure is 25 psi.

The solvent thus delivered through passageways 38 is dispensed adjacent the fastener 26 and the axis X—X to the nose region 42 of the atomizer 12 to clean this region without the need for a reverse-oriented spray nozzle, or "nose washer," mounted on a cleaning shroud as in U.S. Pat. No. 4,275,838. The complexity of a center-feed system, such as that described in OLS No. 30 01 209 is also avoided. Since color changes typically occur with systems of the type described in these prior art systems and in the present system when no article to be coated is before the atomizing device, and since relatively less solvent is needed with the present system than with the system of U.S. Pat. No. 4,275,838 to clean the atomizing device satisfactorily, the shroud can be eliminated with the present system. This reduces cost and complexity of the system. Cost of operation is also reduced because less solvent is used with the present system.

Although the invention has been described in detail with reference to the illustrated embodiment, variations and modifications exist within the scope and spirit of the invention as described and as defined in the following claims.

What is claimed is:

1. A rotary atomizer comprising an interior which flares generally outwardly from an axis and which terminates at an atomizing edge from which atomized material is dispensed, a back side which lies generally on the outside of the atomizer and faces generally in the direction opposite the direction in which the interior faces, the atomizer including means defining a passageway extending between and coupling the back side to the interior to provide for delivery of material to the interior to be atomized when the atomizer is revolved on its axis, means for coupling the atomizer to a drive motor, the passageway initiating at a preselected non-zero radius on the back side of the atomizer and terminating in the interior radially inwardly from the preselected radius.

2. The atomizer of claim 1 wherein the passageway is angled from the back side to the inside from a point more distant from the axis toward a point closer to the axis.

3. The atomizer of claim 1 wherein the passageway is tangentially inclined from the back side to the interior in a direction opposite the direction of revolution of the atomizer.

4. A generally bell-shaped, rotary coating material atomizer including an exterior, an interior, an edge separating the interior and exterior from which coating material is discharged, means for mounting the atomizer along an axis thereof on a shaft for rotation with the shaft, the atomizer including a material delivery cup on the exterior thereof, means defining a material passageway for delivery of material from the cup to the interior for atomization, the material passageway extending between the cup and the interior, the passageway starting at a preselected non-zero radius in the cup and terminating on the interior of the atomizer radially inwardly from the preselected radius.

5. The atomizer of claim 4 wherein the passageway angles inwardly toward the axis from the delivery cup to the interior.

6. A coating material delivery system including a drive motor having a shaft for rotation thereby, an atomizing device having an interior and an exterior, an edge from which atomization is achieved separating the interior and exterior, a delivery cup, a passageway for delivery of coating material from the delivery cup to the interior of the atomizing device at an interior termination of the coating material passageway, and a passageway for the delivery of solvent to the interior, the solvent passageway angling continuously inwardly toward the shaft from the delivery cup to the interior of the atomizing device.

7. The atomizer of claim 6 wherein the solvent passageway terminates on the interior of the atomizing device radially inwardly from the interior termination of the coating material passageway.

8. In an apparatus for atomizing coating material including a motor-driven atomizing device rotated about an axis of rotation in a preselected direction, the device having a front surface and a back surface, a coating nozzle for directing coating material onto the back surface of the device, and means providing a passageway extending through the device for delivering coating material from the back surface to the front surface for atomization and dispensing therefrom, an improved means for cleaning the front surface of the device comprising a cleaning nozzle for directing cleaning material toward the back surface of the device at a preselected non-zero radius from the axis of rotation, and means providing a passageway extending through the device for delivering cleaning material from the back surface to the front surface of the device, the cleaning material passageway inclined inwardly from the preselected radius on the back surface toward the axis on the front surface.

9. The improvement of claim 8 wherein the cleaning material passageway is also tangentially inclined from the back surface away from the preselected direction of rotation.

10. The improvement of claim 9 further comprising means for delivering the cleaning material through the cleaning nozzle under superatmospheric pressure.

11. The improvement of claim 9 wherein the delivery means comprises means for adding superatmospheric air to the cleaning material prior to its passing through the cleaning nozzle.

* * * * *